US010584663B1

(12) United States Patent
Yasuzaka et al.

(10) Patent No.: US 10,584,663 B1
(45) Date of Patent: Mar. 10, 2020

(54) EVAPORATIVE FUEL LEAK CHECK SYSTEM

(71) Applicants: DENSO International America, Inc., Southfield, MI (US); DENSO CORPORATION, Kariya, Aichi-pref. (JP)

(72) Inventors: Taiki Yasuzaka, Kariya (JP); Shigeru Hasegawa, Novi, MI (US); Jeffrey Meng, New Hudson, MI (US)

(73) Assignees: DENSO International America, Inc., Southfield, MI (US); DENSO CORPORATION, Kariya, Aichi-pref. (JP)

( * ) Notice: Subject to any disclaimer, the term of this patent is extended or adjusted under 35 U.S.C. 154(b) by 0 days.

(21) Appl. No.: 16/166,634

(22) Filed: Oct. 22, 2018

(51) Int. Cl.
*F02M 25/08* (2006.01)
*F02M 37/00* (2006.01)
*F02D 41/00* (2006.01)

(52) U.S. Cl.
CPC ..... *F02M 25/0818* (2013.01); *F02D 41/003* (2013.01); *F02M 37/0076* (2013.01); *F02D 2200/021* (2013.01); *F02D 2200/0606* (2013.01); *F02D 2200/503* (2013.01)

(58) Field of Classification Search
CPC ..... F02M 25/08; F02M 25/0818; F02M 37/0076; F02D 41/003; F02D 2200/021; F02D 2200/0606; F02D 2200/503
See application file for complete search history.

(56) References Cited

U.S. PATENT DOCUMENTS

| | | | | |
|---|---|---|---|---|
| 9,050,885 | B1 * | 6/2015 | Dudar | B60W 20/00 |
| 2003/0010095 | A1 | 1/2003 | Hirano et al. | |
| 2007/0189907 | A1 | 8/2007 | Kunihiro et al. | |
| 2009/0007641 | A1 | 1/2009 | Haag | |
| 2013/0206115 | A1 * | 8/2013 | Kragh | F02M 31/20 123/519 |
| 2014/0041642 | A1 * | 2/2014 | Tsutsumi | F02M 31/00 123/541 |

* cited by examiner

*Primary Examiner* — Thomas N Moulis

(57) ABSTRACT

An engine off natural vacuum (EONV) evaporative fuel leak check system includes a fuel tank, a heat exchanger, an air duct, a fan, a fuel temperature sensor, and a controller. The fan directs air onto the heat exchanger, and the heat exchanger heats air passing around the heat exchanger in a heat exchange process using heat from engine coolant within the heat exchanger. The air duct extends between the fuel tank and the heat exchanger and the fan moves the heated air through the air duct toward the fuel tank. The controller is configured to control the fan for moving the heated air toward the fuel tank based on a temperature of the fuel within the fuel tank, as detected by the fuel temperature sensor.

12 Claims, 8 Drawing Sheets

EVAPORATIVE FUEL LEAK CHECK SYSTEM

TECHNICAL FIELD

The present disclosure relates to a system and method for checking evaporative fuel leaks in a fuel processing system.

BACKGROUND

This section provides background information related to the present disclosure, which is not necessarily prior art.

Liquid fuel such as gasoline stored in a vehicle fuel tank (e.g., fuel tank of an automobile) may be vaporized and remain in the fuel tank as evaporative fuel. The evaporative fuel may be supplied to an intake manifold of an internal combustion engine through an evaporative fuel processing system.

The vehicle, or rather systems of the vehicle, may check for leaks in the evaporative fuel processing system after stopping the engine. That is, the vehicle systems may determine whether there are evaporative fuel leaks in the evaporative fuel processing system after turning the engine off.

After stopping the engine, valves of the evaporative fuel processing system are closed to form a closed circuit and leaks of evaporative fuel from the evaporative fuel processing system are determined on the basis of changing pressure gradients.

There are strict emission standards and regulations for evaporative fuel leaks from the fuel tank. As such, vehicles may employ various technologies to determine evaporative fuel leaks as quickly as possible.

Existing evaporative fuel leak check systems, however, may have difficulties in determining evaporative fuel leaks in vehicles with downsized engines, hybrid vehicles, vehicles with start-stop engine systems to limit engine idling, and vehicles with other fuel saving technologies, and thus, are subject to improvement.

SUMMARY

This section provides a general summary of the disclosure, and is not a comprehensive disclosure of its full scope or all of its features.

The present disclosure includes systems and methods for performing an evaporative fuel leak check in an evaporative fuel processing system.

According to one aspect of the present disclosure, an EONV evaporative fuel leak check system may include a fuel tank, a heat exchanger, an air duct, a fan, a fuel temperature sensor, and a controller. The fuel tank may store a liquid fuel. The heat exchanger may heat air around the heat exchanger by exchanging a heat of an engine coolant flowing through the heat exchanger with the air. The air duct may extend between the fuel tank and the heat exchanger. The fan may be configured to move the air around the heat exchanger and further through the air duct toward the fuel tank. The fuel temperature sensor may detect a temperature of the fuel and output a fuel temperature signal. The controller may be configured to determine a fuel temperature difference over a predetermined duration based on fuel temperature signals detected by the fuel temperature sensor at a beginning and an end of the duration. When the fuel temperature difference is less than a fuel temperature difference threshold value, the controller may be further configured to turn on the fan.

According to another aspect of the present disclosure, a method for an EONV evaporation leak check may include detecting a temperature differential of a fuel within a fuel tank, and turning on a fan to blow air on and around a heat exchanger to heat the air from an engine coolant within the heat exchanger and blow the heated air toward the fuel tank when the temperature differential of the fuel is lower than a fuel temperature difference threshold value.

According to this configuration, even when the fuel tank does not receive enough heat from a residual heat in a vehicle's exhaust system when the vehicle's engine is turned off, an EONV leak check may still be performed using alternative heat sources to heat the fuel tank. This configuration also increases the likelihood and frequency of EONV leak checks in hybrid vehicles, vehicles with smaller engines, and vehicles using fuel saving technologies, where the engines of such vehicle may not produce as much heat to heat the exhaust system as vehicles with larger, conventional engines.

BRIEF DESCRIPTION OF DRAWINGS

Objects, features, and advantages of the present disclosure will become more apparent from the following detailed description made with reference to the accompanying drawings, in which.

DETAILED DESCRIPTION

Figure 1:
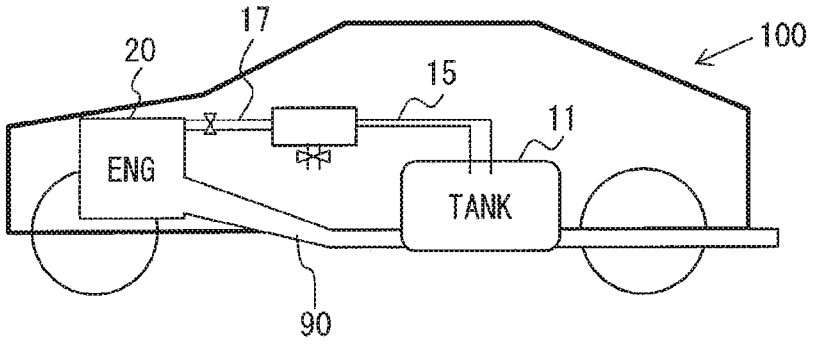
FIG. 1 is a schematic diagram of a configuration of an evaporative fuel leak check system.

An embodiment of the present disclosure will be described with reference to the drawings. In the embodiment and modifications described below, like elements and features in the embodiment and its modifications may be referred to by the same reference character, and a repeat description of such elements and features may be omitted for brevity.

Vehicles having downsized engines such as those with smaller, more fuel efficient engines, hybrid vehicles, and other fuel efficient technology, may have internal combustion engines that may not produce as much heat as conventional internal combustion engines. For example, depending on driving conditions, a hybrid vehicle may rely on an electric motor to drive the vehicle at low speeds, such as city driving, where the vehicle's combustion engine may be used minimally, if at all. In such cases, the residual heat in a hybrid vehicle engine when the vehicle is turned off may be very low. That is, the heat or temperature of the engine may be very low when the vehicle is turned off as compared to vehicles with conventional internal combustion engines. Similarly, a vehicle having a start-stop system where the engine is turned off to limit engine idling and conserve fuel may have a lower engine residual temperature when the vehicle is turned off, because the engine in a vehicle with a start-stop system runs much less than a conventional engine that runs when idling. A smaller engine that burns less fuel may have a decreased power output and produce less heat than a larger, conventional engine. As such, the smaller engine may have less residual heat and be at a lower temperature when the vehicle having the smaller engine is turned off.

As an engine off natural vacuum (EONV) evaporative fuel leak check system may rely on heat produced by a vehicle engine to heat a fuel in a vehicle fuel tank to increase a pressure of the evaporative fuel processing system for determining evaporative fuel leaks, vehicles with smaller engines or engines that run less may produce smaller amounts of heat. Consequently, vehicles with smaller, downsized engines and engines that run less may not produce enough heat to heat the fuel in the vehicle fuel tank to pressurize the evaporative fuel processing system to test for evaporative fuel leaks. As such, vehicles with smaller engines and engines that run less may not be able adequately heat the vehicle fuel tank to perform an EONV evaporative fuel leak check.

It is an object of the present disclosure to provide a system and method for performing a leak check on an evaporative fuel processing system. Specifically, the present disclosure contemplates different configurations and methods for heating fuel in a vehicle fuel tank for performing an evaporative fuel leak check.

Figure 2:
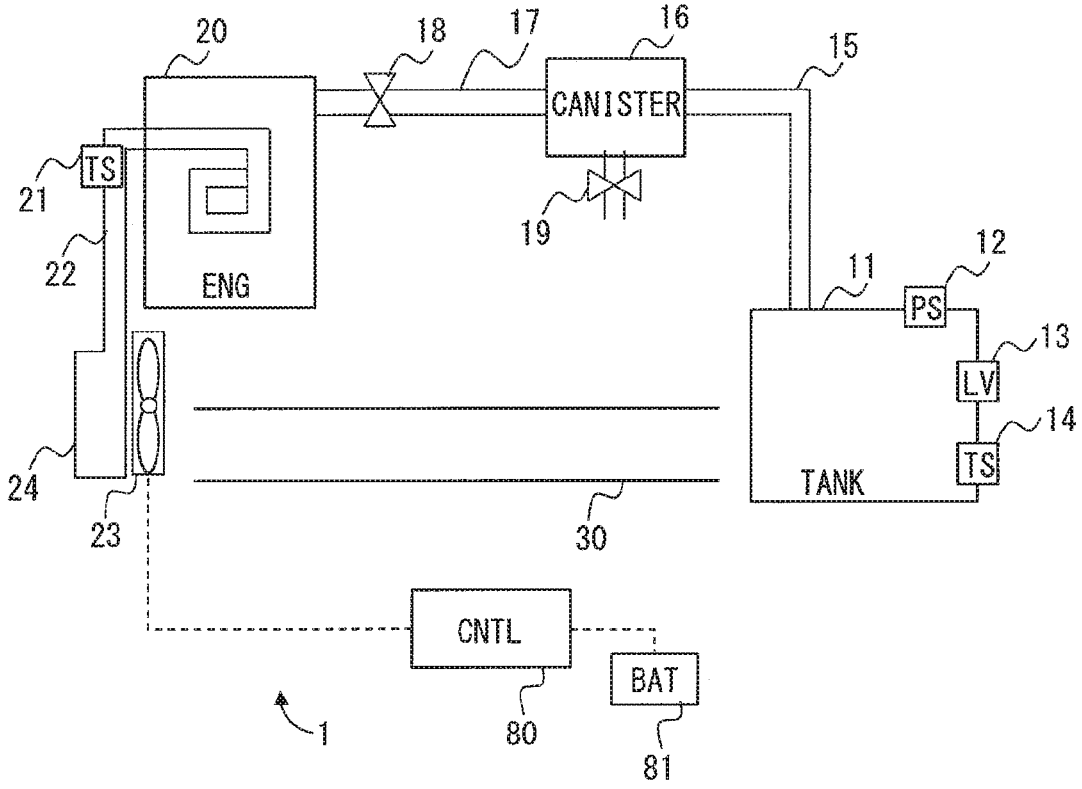
FIG. 2 is a schematic diagram of a configuration of an engine off natural vacuum (EONV) leak check system.

With reference to FIGS. 1 and 2, an EONV leak check system 1 may be disposed within a vehicle 100. The EONV leak check system 1 may check for evaporative fuel leaks by detecting natural pressure changes in a fuel tank 11 and evaporative fuel passages, including an evaporative fuel passage 15 (also referred to as a first purge passage) and an evaporative fuel passage 17 (also referred to as a second purge passage). The fuel tank 11 may be used to hold a liquid fuel such as gasoline for combustion in the engine 20 of the vehicle 100. A portion of the liquid fuel in the fuel tank 11 may vaporize and remain as vaporized or evaporative fuel in the fuel tank 11 and the evaporative fuel passages 15 and 17. In the EONV leak check system 1, the fuel tank 11 and the evaporative fuel passages 15, 17 form a closed circuit. The fuel tank 11 and evaporative fuel passages 15 and 17 may be part of an evaporative fuel processing system that also includes a canister 16, a purge value 18, and a canister vent value 19.

The EONV leak check system 1 may test for evaporative fuel leaks by closing the purge valve 18 and the canister vent valve 19, so that the fuel tank 11 and the evaporative fuel passages 15 and 17 form a closed circuit. In a closed system, the pressure of the fuel within the closed system changes as the temperature of the fuel changes. That is, the fuel pressure increases, and thus the pressure within the closed system increases when the temperature of fuel within the closed system increases. Likewise, the fuel pressure and closed system pressure decreases as the temperature of the fuel decreases.

When the vehicle 100 with the EONV leak check system 1 is driving, the fuel tank 11 and fuel stored therein may be warmed by heat from an exhaust pipe 90. As shown in FIG. 1, the exhaust pipe 90 is used to exhaust hot gases generated during combustion away from the engine 20.

When the vehicle 100 stops driving and the ignition switch is turned off, residual heat in the engine 20 and the exhaust pipe 90 may be transferred to the fuel tank 11. That is, after the vehicle 100 is turned off, residual heat in the engine 20 and the exhaust pipe 90 may be used to heat the fuel in the fuel tank 11 and increase the pressure in the closed system. However, when vehicle 100 is a hybrid vehicle, has a smaller engine 20, or uses technology like an engine start-stop system where the engine 20 runs less frequently, the heat produced by engine 20 and transferred to the exhaust pipe 90 may be much less than the heat produced and transferred to the exhaust pipe in vehicles, with larger, more conventional engines.

(Embodiment of the EONV Leak Check System)

One embodiment of the EONV leak check system 1 is described with reference to FIG. 2. While FIG. 1 shows the vehicle 100 using an EONV leak check system that may heat the fuel in the fuel tank 11 using heat from the exhaust pipe 90, the present disclosure contemplates using the EONV leak check system 1 in the present embodiment and its modifications in addition to, or in place of, the exhaust pipe 90. The present disclosure describes an EONV leak check system 1 that is used in addition to (i.e., along with) the configuration shown in FIG. 1.

The EONV leak check system 1 of the present disclosure may be disposed in the vehicle 100. The vehicle 100 may have a reduced size internal combustion engine 20. For example, the vehicle 100 may be a hybrid vehicle, where the size of the engine 20 is reduced so as to accommodate both an internal combustion engine 20 and an electric motor (not illustrated) for driving the vehicle 100. That is, the volume of the engine 20 in the hybrid vehicle may be smaller than a volume of an internal combustion engine 20 in the vehicle 100 where the engine 20 is the only power source. The size of the engine 20 in vehicle 100 may be reduced for other reasons. For example, the engine 20 may include an exhaust compression device such as a turbocharger or supercharger to increase the fuel economy of the vehicle 100 and output power of the engine 20, while also reducing the volume of the engine 20.

In instances where the vehicle 100 has a reduced size engine 20, the engine 20 alone transferring heat to the exhaust pipe 90 may not produce enough heat to heat the fuel in the fuel tank 11 for performing the EONV leak check. In other words, the fuel temperature in the fuel tank 11 of the hybrid vehicle 100 may not increase enough to perform the EONV leak check. As such, the EONV leak check may be performed less, or at a decreased frequency.

(Configuration of the EONV Leak Check System)

The EONV leak check system 1 is configured to check for evaporative fuel leaks.

The EONV leak check system 1 includes the fuel tank 11, the canister 16, the evaporative fuel passage 15 that connects the fuel tank 11 and the canister 16, and the evaporative fuel passage 17 that connects the canister 16 and an intake manifold of the engine 20. The EONV leak check system 1 may further include the purge valve 18 that is disposed in the evaporative fuel passage 17 between the intake manifold and the canister 16.

The fuel tank 11 may include a variety of sensors, such as a pressure level sensor 12, a fuel level sensor 13, and a fuel temperature sensor 14. The various sensors may detect and measure an input quantity, and then output a signal indicative of the detected and/or measured amount. The pressure level sensor 12 detects a pressure within the fuel tank 11. The fuel level sensor 13 detects a level or amount of liquid fuel within the fuel tank 11. The fuel temperature sensor 14 detects the temperature of the fuel within the fuel tank 11. The sensors 12, 13, and 14 may output signals indicative of their detections to a controller or other processor. For example, the pressure level sensor 12 may output a pressure level signal, the fuel level sensor 13 may output a fuel level signal, and the fuel temperature sensor 14 may output a fuel temperature signal. The sensors 12, 13, and 14 may detect input quantities on a continuous basis and output a continuous stream of output signals, or the sensors 12, 13, and 14 may be configured to make periodic or on demand readings, and output an output signal in response.

The canister 16 includes activated carbon that adsorbs evaporative fuel. The canister 16 may include a passage for communicating with the atmosphere. The canister vent valve 19 is provided in the middle of the passage and is normally in an open valve state. Evaporative fuel stored in the canister 16 may flow to the intake manifold and further to the engine 20 when the purge valve 18 is open.

In addition to the above configurations, the EONV leak check system 1 includes an engine coolant circulation passage 22 in which water or coolant for cooling the engine 20 flows. The EONV leak check system 1 further includes a radiator 24 that is connected to the engine coolant circulation passage 22. The EONV leak check system 1 includes a radiator cooling fan 23 that blows air on the radiator 24 to exchange heat from the engine coolant to the air. In other words, the radiator cooling fan 23 may move air onto, through, and/or around the radiator 24 to cool the radiator, and the air from the radiator cooling fan acting on the radiator 24 may be heated through a heat exchange process as a result of cooling the heated water/coolant flowing in the radiator 24. As the heat exchange process with the radiator 24 may be used to heat air, the radiator may be referred to herein as a heat exchanger 24, and the radiator cooling fan 23 may be referred to simply as a fan 23.

The EONV leak check system 1 includes a coolant temperature sensor 21 that detects the temperature of the engine coolant. The coolant temperature sensor 21 is disposed at a position upstream relative to the radiator 24 in the engine coolant circulation passage 22. As such, the coolant temperature sensor 21 detects the temperature of the engine coolant before reaching the radiator 24. The coolant temperature sensor 21 may detect a temperature of the engine coolant and output a coolant temperature signal in response. The coolant temperature sensor 21 may make coolant temperature readings continuously, periodically, or on demand, and output coolant temperature signals in response.

The EONV leak check system 1 includes an air duct 30 that directs the heated air from the radiator 24 toward the fuel tank 11. In the present embodiment, the air duct 30 extends between the fuel tank 11 and the radiator 24. The EONV leak check system 1 includes a controller 80. The controller 80 may include a microcomputer having a CPU, a ROM, RAM, an I/O port, and like components. The ROM may be a non-transitory tangible computer readable medium for storing a program or an instruction set that may be executed by the CPU. The execution of such a program or instruction may cause the controller 80 and other components of the EONV leak check system 1 to perform one or more specific tasks and processes. The controller 80 may receive data from each of the pressure level sensor 12, the fuel level sensor 13, the fuel temperature sensor 14, and the coolant temperature sensor 21. The controller 80 may be configured to control a procedure performed by the EONV leak check system 1, such as opening and closing the purge valve 18, opening and closing the canister vent valve 19, and turning the radiator cooling fan 23 on and off. For example, the controller 80 may provide a control signal for closing the canister vent valve 19 during an EONV leak check after the controller 80 detects that a vehicle ignition switch has been switched off.

The controller 80 is connected with a battery 81 and is configured to be supplied with electric power from the battery 81 even when the ignition switch is turned off. As such, the controller 80 may perform a control process such as a leak check detection when the vehicle ignition switch is off.

(Procedure Performed by the EONV Leak Check System)

Figure 3:
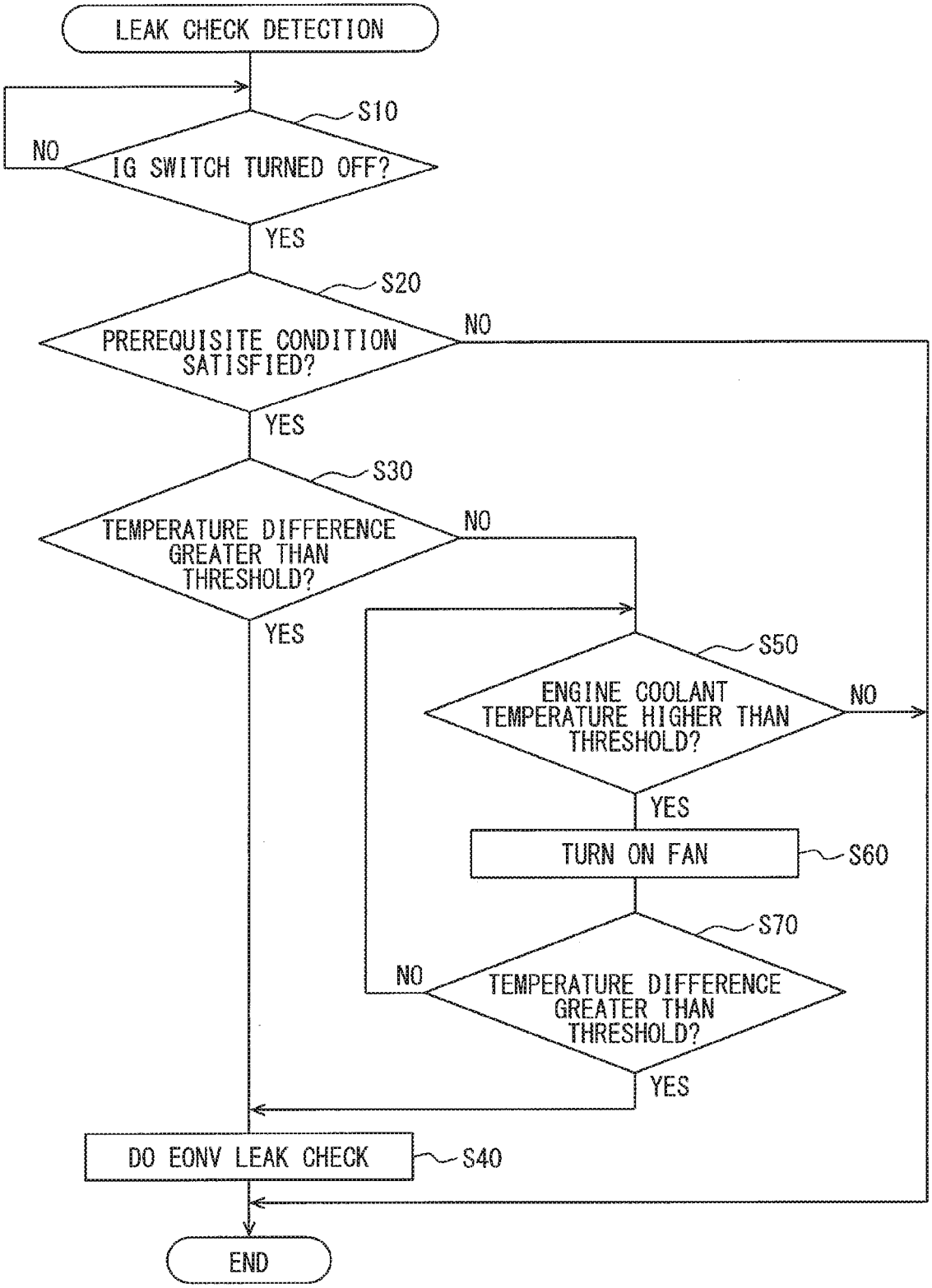
FIG. 3 is a flowchart of an evaporative fuel leak check process performed by the EONV leak check system of FIG. 2.

A leak check procedure (also referred to as a leak check detection) performed by the EONV leak check system 1 is described with reference to FIG. 3. The processes of the leak check procedure may be performed by the controller 80.

At S10, the controller 80 determines whether the ignition switch is turned off. That is, the leak check procedure may begin when the engine 20 of the vehicle 100 is still running and the ignition switch is on. If the ignition switch has not been turned off, i.e., "NO" at S10, the process repeats until the controller 80 detects that the ignition switch is turned off. When the controller 80 detects that the ignition switch is turned off, i.e., "YES" at S10, the procedure shifts to S20.

At S20, the controller 80 determines whether a prerequisite condition for the EONV leak check is satisfied. The prerequisite condition may include one or more of the following example conditions: the liquid fuel level in the fuel tank 11 is between 15% and 85% of the total volume of the fuel tank 11; a run time for the engine 20 is greater than a predetermined value; and a travel distance of the vehicle 100 exceeds a predetermined distance. An example prerequisite condition may be where the vehicle engine has been running for at least 20 minutes. Another example prerequisite condition may be where a vehicle has traveled at least 10 miles before the vehicle engine is turned off. The afore-described examples are non-limiting, and the prerequisite conditions may be a singular condition or combination of conditions (e.g., fuel level in addition to engine run time and vehicle travel distance).

The controller 80 receives data of the liquid fuel level from the fuel level sensor 13. The controller 80 may include a timer (not shown) to determine an elapsed run time of the engine 20. The controller 80 may receive travel distance data from another ECU. For example, the controller 80 may determine the travel distance of the vehicle 100 by receiving odometer data from another ECU at the beginning and end of a trip, where a trip may be determined from when the ignition switch of the vehicle 100 is turned on until the ignition switch of the vehicle 100 is turned off.

The above-described prerequisite conditions are non-limiting examples, and the controller 80 may use additional perquisite conditions or modifications of the above-described prerequisite conditions. The engine run time, travel distance, and liquid fuel level for vehicles using the EONV leak check system 1 may vary from vehicle to vehicle. For example, a non-hybrid vehicle that does not include an electric assist motor may have a shorter engine run time or travel distance prerequisite.

When the controller 80 determines that the prerequisite condition for the EONV leak check is satisfied, i.e., "YES" at S20, the procedure shifts to S30. When the controller 80 determines that the prerequisite condition is not satisfied, the procedure ends.

At S30, the controller 80 closes the canister vent valve 19 and the purge valve 18 to seal the evaporative fuel processing system.

After the evaporative fuel processing system is sealed, the fuel temperature sensor 14 detects the temperature of the fuel stored in the fuel tank 11 and the pressure level sensor 12 detects the pressure in the fuel tank 11.

The processes performed by the controller 80 at S20 and S30 may be included as part of a pre-check process. The pre-check process may be used to determine whether the engine 20 in the vehicle 100 has produced and transferred enough heat to the exhaust pipe 90 for heating the fuel in the fuel tank 11 as part of performing the EONV leak check, or whether the additional elements of the EONV leak check system 1 are to be used for heating the fuel in the fuel tank 11.

At S30, the controller 80 determines a fuel temperature difference, which may be referred to as ΔTpre, of the fuel over a predefined duration. That is, at the beginning of the predefined duration the controller 80 may take a reading from the fuel temperature sensor 14 to determine starting temperature value of the fuel, and may take a reading from the fuel temperature sensor 14 at the end of the predefined duration to determine an end temperature value of the fuel. For example, the controller 80 may take fuel temperature signals from the fuel temperature sensor 14 at the beginning and end of the pre-check process to determine a fuel temperature difference. The temperature difference is calculated as the difference between the end temperature value of the fuel and the starting temperature value of the fuel. The predefined duration or period for determining the temperature difference may be based on a variety of factors such as a type of the vehicle, capacity of the fuel tank. For example, the controller 80 may calculate the fuel temperature difference by taking fuel temperature readings at the beginning and end of a 100 second pre-check period. The controller 80 may also determine a pressure difference, which may be referred to as ΔPpre, in the fuel tank during this same period in a similar manner, e.g., by taking pressure readings from the pressure level sensor 12 at the beginning and end of the period to calculate the pressure difference. Since the fuel tank 11 may continue to receive residual heat from the exhaust pipe 90 immediately after the ignition switch is turned off (e.g., immediately after the vehicle 100 stops driving and the engine 20 stops), both the fuel temperature and the pressure within the fuel tank 20 may rise so that the temperature difference and pressure difference are positive values. After S30, the controller 80 may open the canister vent valve 19 and the purge valve 18 to release pressure from the evaporative fuel processing system. That is, after the pre-check process is performed, the controller 80 may open valves 18 and 19 of the evaporative fuel processing system to release pressure. If the controller 80 determines that a EONV leak check is to be performed, the controller may close the purge valve 18 and the canister vent valve 19 prior to performing the EONV evaporative fuel leak check.

When the temperature difference is greater than a predetermined fuel temperature difference threshold value, i.e., "YES" at S30, the controller 80 determines that the fuel tank 11 receives enough heat to perform the EONV leak check and the procedure shifts to S40 where the controller 80 performs an EONV leak check. Prior to S40, the controller 80 closes the valves 18, 19 on the evaporative fuel processing system.

After the EONV leak check is performed at S40, the leak detection process ends.

If however the temperature difference is not greater than the predetermined threshold value, i.e., "NO" at S30, the controller 80 determines that the fuel tank 11 has not received enough heat for performing an EONV leak check. In this case, even when the evaporative fuel processing system is sealed, the increase in temperature to the fuel tank 11 may not be enough to heat the fuel in the fuel tank 11. As such, the pressure of the fuel in the fuel tank 11 may only increase slightly, if at all, and it may be difficult to determine whether there is any leakage in the evaporative fuel processing system. When the controller 80 determines that the temperature difference is not greater than a preset fuel temperature difference threshold at S30, the procedure shifts to S50.

At S50, the controller 80 receives the coolant temperature from the coolant temperature sensor 21 and the controller 80 determines whether the coolant temperature is higher than a coolant temperature threshold value. When the controller 80 determines that the temperature of the engine coolant/water is higher than the threshold temperature, the procedure shifts to S60 in order to utilize the heat of the engine coolant. When the temperature of the engine coolant is not higher than the threshold temperature, i.e., "NO" at S50, the procedure ends. Prior to S60, the controller 80 closes the valves 18, 19 on the evaporative fuel processing system.

At S60, the controller 80 turns on the radiator cooling fan 23. When the radiator cooling fan 23 is turned on, a pump (not shown) provided in the engine coolant circulation passage may also be operated to improve the circulation of the engine coolant. The radiator cooling fan 23 is used for a heat exchange process with the radiator 24. When the radiator cooling fan 23 is turned on, the fan 23 blows air onto, through, and/or around the radiator 24 to cool the engine coolant. As a result, the air blown onto the radiator 24 from the cooling fan 23 is heated from the engine coolant and is further channeled through the air duct 30. The radiator cooling fan 23 blows the heated air through the air duct 30. A downstream side of the air duct 30 is in contact with the fuel tank 11 and the heated air moving through the air duct 30 transfers heat to the fuel tank 11. More specifically, the heated air may be used to heat the fuel in the fuel tank 11.

At S70, the controller 80 makes another temperature difference calculation and determines whether the fuel temperature difference is greater than a threshold value. The controller calculates the temperature difference in a similar manner to the process at S30. When the controller 80 determines that the temperature difference is not higher than the threshold value, the procedure returns to S50. When the temperature difference is higher than the threshold value, the controller 80 determines that the fuel tank 11 has received enough heat to perform the EONV leak check and the procedure shifts to S40.

As described above, the controller 80 determines the temperature difference of the fuel at S30. When the fuel tank 11 receives enough heat from the exhaust pipe 90, the heat from the exhaust pipe 90 may be enough to raise the temperature of the fuel so that the temperature difference is higher than the threshold value. In this case, it may be unnecessary to provide auxiliary heat to heat the fuel tank 11. By contrast, when the temperature difference is not higher than the threshold value at S30, that is, when the fuel tank 11 has not received enough heat to increase the fuel temperature so that the temperature difference becomes larger than a threshold value, the fuel tank and fuel may be heated by the heat of the engine coolant.

When the fuel temperature variations, that is, the fuel temperature differences, are small, the pressure differences may also be small. As such, it may be difficult to determine whether the evaporative fuel processing system has a leak when the fuel temperature difference and the pressure difference are small. For example, minute (small) temperature difference and minute pressure difference may require temperature and pressure sensors with a high degree of precision, and such sensors may be very expensive and impractical for use in a vehicle.

The EONV leak check system 1 of the present disclosure utilizes the heat of the engine coolant after driving the vehicle when the heat from the exhaust pipe 90 is not enough to heat the fuel in the fuel tank 11.

In order to heat the fuel tank 11 using the heat of the engine coolant, the EONV leak check system 1 utilizes the air duct 30, the radiator 24, and the radiator cooling fan 23. Here, the radiator 24, the radiator cooling fan 23, and the engine coolant circulation passage 22, may be part of, or be components in the vehicle's heating, ventilation, and air conditioning (HVAC) system. In other words, according to the present disclosure, the heat from the vehicle's HVAC system may be utilized in order to increase the temperature of the fuel.

When the heat from the exhaust pipe 90 is not enough to heat the fuel in the fuel tank 11 so that the fuel temperature difference is greater than a threshold value, the controller 80 controls the radiator cooling fan 23 to turn on when the temperature of the engine coolant is higher than a threshold temperature. However, the controller 23 does not turn the fan 23 on if the engine coolant temperature is below a threshold temperature value, even in cases where the heat from the exhaust pipe 90 is not enough to heat the fuel in the fuel tank 11.

Based on this configuration, even when the fuel tank 11 does not receive enough heat from the exhaust pipe 90 when the vehicle 100 stops driving, it may still be possible to perform the EONV leak check by utilizing the heat of the engine coolant. In other words, the present disclosure provides alternative heat sources for heating the fuel in the fuel tank 11 for conducting an EONV leak check that may be useful in vehicles that do not generate enough heat from the exhaust pipe 90 alone, such as vehicles with downsized engines, hybrid engines, and other fuel saving technologies.

(First Modification)

Figure 4:
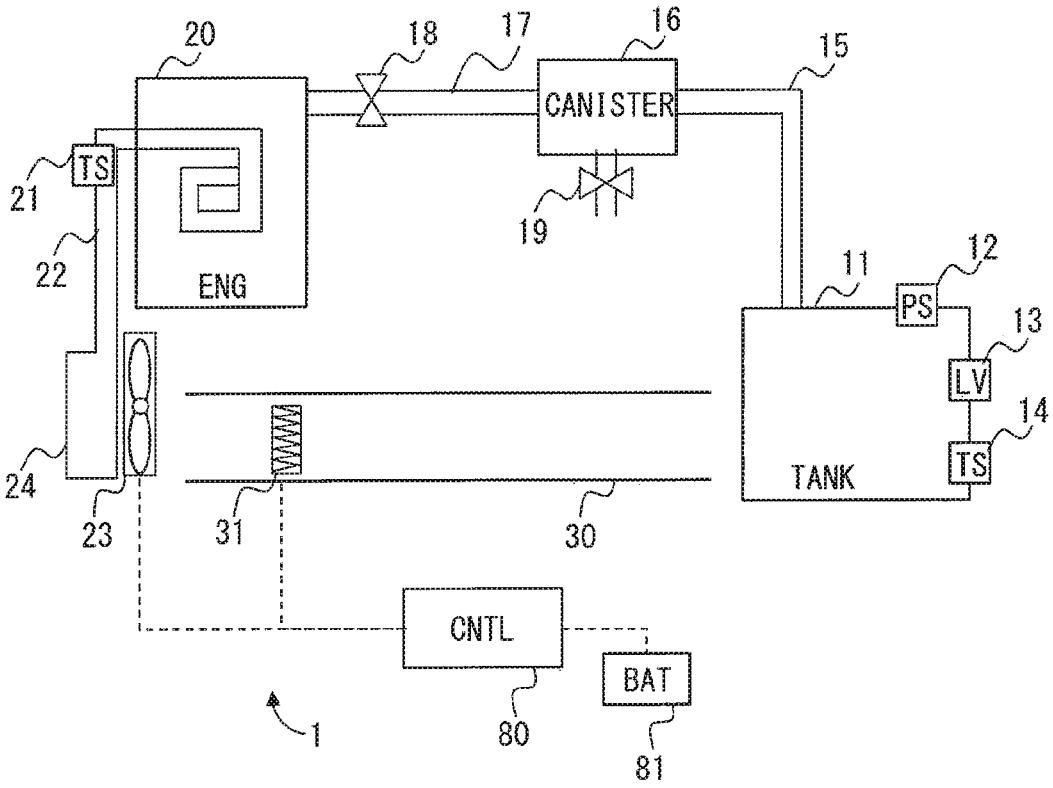
FIG. 4 is a schematic diagram of a modified configuration of an EONV leak check system.

In the above-described embodiment, the air duct 30 is provided to direct heated air to the fuel tank 11 after a heat exchange process with the radiator 24. A first modification is described with reference to FIG. 4.

In the first modification, the EONV leak check system 1 may include a heater 31 disposed in the air duct 30. Alternatively, the heater 31 may be disposed anywhere so that the air passing through the air duct 30 is heated. The EONV leak check system 1 includes the battery 81 for supplying electric power to the heater 31. That is, the heater 31 may be an electric heater that uses power from the battery 81 to produce heat. The battery 81 may be exclusively used by the heater or may be shared with other components in the vehicle 100 for providing power.

The heater 31 is connected with the battery 81, and the controller 80 controls the power supply from the battery 81 to the heater 31 by controlling a switch or switching circuit (not shown) to turn the heater 31 on and off. When the exhaust pipe 90 and the heat from the engine coolant do not provide enough heat to raise the temperature of the fuel in the fuel tank 11 for performing the EONV leak check, the heater 31 may be used to provide heat to the fuel tank 11. The radiator cooling fan 23 may be used to blow and direct air heated by the heater 31 through the air duct 30 toward the fuel tank 11.

An example procedure performed by this modification is described with reference to FIG. 5 and highlights the differences from the procedure shown in FIG. 3.

At S50, the controller 80 determines whether the engine coolant temperature is higher than the threshold temperature. In this modification, when the engine coolant temperature is not higher than the threshold temperature, i.e. "NO" at S50, the procedure shifts to S90, instead of ending the EONV leak check process.

At S90, the controller 80 determines whether the battery 81 has enough charge for powering the heater 31. Specifically, the controller 80 determines whether a state of charge (SoC) of the battery 81 is higher than a predetermined battery threshold level. At S90, the controller 80 may not only determine the SoC of the battery 81, but may also determine whether the SoC of the battery 81 is enough for powering the heater 31 in addition to reserving battery power for other uses. For example, determining the SoC of the battery 81 may mean the controller 80 determines if the SoC of the battery 81 is enough for running the heater 31 and determines whether the remaining SoC of the battery 81 after running the heater 31 is enough to power the vehicle for a certain distance using an electric motor. When the state of charge is higher than the battery threshold level, i.e. "YES" at S90, the controller 80 determines that the battery 81 has been charged enough for powering the heater 31 and the procedure shifts to S100. Prior to S100 the controller 80 closes the valves 18, 19 on the evaporative fuel processing system. When the state of charge is not higher than the battery threshold level, i.e. "NO" at S90, the procedure is terminated and the EONV leak check process ends.

At S100, the controller 80 turns on the heater 31, for example, by controlling a switch to supply electric power from the battery 81 to the heater 31. After S100, the procedure shifts to S60. At S60, the controller 80 turns on the radiator cooling fan 23.

The first modification can achieve the same effects as those achieved by the above-described embodiment. Additionally, the first modification increases the capability of the EONV leak check system 1 performing an EONV leak check due to the addition of the heater 31. As such, when the heat from the exhaust pipe 90 and the heat from the engine coolant are not enough to heat the fuel in the fuel tank 11 for performing an EONV leak check, the heater 31 may be used to heat the fuel, thereby ensuring the probability that an EONV leak check can be performed. Therefore, the addition of the heater 31 may increase the likelihood that the EONV leak check is performed.

Since the heater 31 provides an additional heat source and may act as a backup heat source to the heat produced from the engine coolant, the threshold temperature of the engine coolant measured at S50 in the first modification may be different from the threshold temperature of the engine coolant in the above-described embodiment. For example, the threshold temperature of the engine coolant in the first modification may be lower than the threshold temperature of the engine coolant in the above-described embodiment.

(Second Modification)

In the above-described embodiment and the first modification, the air duct 30 is provided to supply air heated by the radiator 24 to the fuel tank 11 using the radiator cooling fan 23. In the second modification, a second air duct 35 may be provided in addition to, or in place of, the air duct 30 in the above-described embodiment and the first modification. The second modification is explained with reference to FIG. 6. For ease of understanding, FIG. 6 only illustrates the air duct 35, though the second modification contemplates the use of both air duct 30 and the second air duct 35. Unless the description refers to the air duct 35 as the second air duct 35 to differentiate the air duct 35 from the air duct 30, the second air duct 35 may be referred to herein simply as the air duct 35.

As the engine 20 may generate heat during the combustion process, the air around the engine may be heated. That is, while the engine 20 is running, the air in an engine bay may be heated due to its proximity to the engine 20. As such, heat from the engine 20 may be exchanged with air in the engine bay to heat the air in the engine bay. As such, the engine 20 may be referred to as a heat exchanger. The air heated by the engine 20 may be used to heat the fuel in the fuel tank 11 for performing the EONV leak check.

The EONV leak check system 1 in the second modification may include the air duct 35 and a blower fan 36. One opening of the air duct 35 may be placed near the engine 20, and the other opening of the air duct 35 may open toward the fuel tank 11. That is, the air duct 35 is configured and disposed to provide a passage of heated air from the engine bay toward the fuel tank 11.

Figure 6:
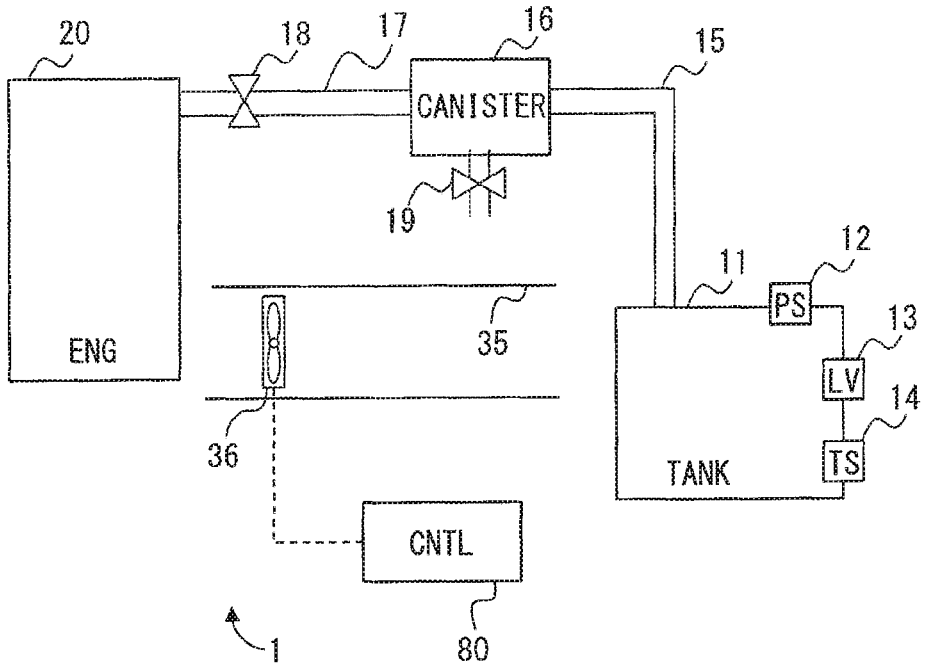
FIG. 6 is a schematic diagram of a modified configuration of an EONV leak check system.

The blower fan 36 may be attached to the air duct 35. The blower fan 36 may be a centrifugal fan configured to blow air through the air duct 35. As shown in FIG. 6, the blower fan 36 may be disposed within the second air duct 35. The specific placement of the blower fan 36 is not limited to this example, and the blower fan 36 may be positioned at any location so long as the blower fan 36 blows and directs the air heated by the engine 20 toward the fuel tank 11. The blower fan 36 may be controlled by the controller 80. That is, the controller 80 may be used to turn the blower fan 36 on and off.

For the second modification, an EONV leak check process similar to the EONV leak check process of the above-described embodiment may be used. With reference to FIG. 3, for the second modification, the process at S50 may be skipped since the second modification may not use the engine coolant to heat the fuel tank 11. When the controller 80 controls the blower fan 36 to turn on, the air warmed by the engine 20 is blown through the air duct 35 toward the fuel tank 11 to heat the fuel tank 11.

The configuration of the second modification may be used to heat the fuel in the fuel tank 11 and thus increase the likelihood that the EONV leak check process can be performed. The second modification can achieve effects similar to the effects of the above-described embodiment.

(Third modification)

Figure 7:
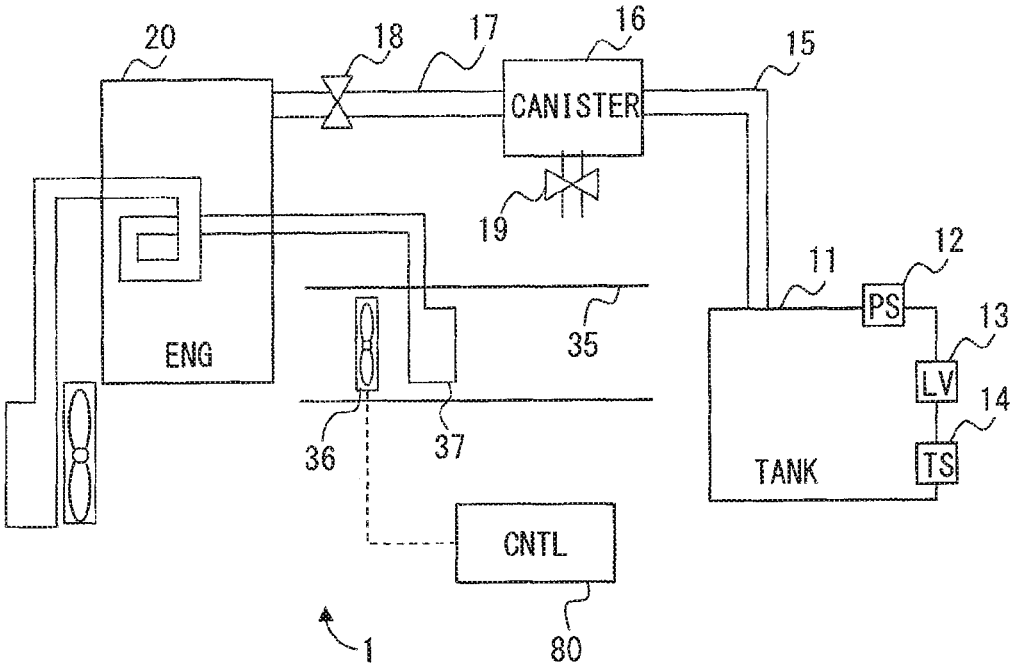
FIG. 7 is a schematic diagram of a modified configuration of an EONV leak check system.

A third modification is described with reference to FIG. 7. In the third modification, the EONV leak check system 1 may include a heater core 37, an air duct 35, and a blower fan 36. In the third modification, because air blown by the blower fan 36 onto, through, and/or around the heater core 37 heats the air by exchanging a heat of the engine coolant within the heater core 37 with the air, the heater core 37 may be referred to as a heat exchanger. The blower fan 36 may be simply referred to as fan 36.

Similar to the second modification, the air duct 35 may be included in addition to, or in place of, the air duct 30. The air duct 35 may have a configuration similar to the configuration described in the second modification. However, the one opening of the air duct 35 is not limited to a position near the engine since air for heating the fuel tank 11 may be heated in conjunction with, or additionally by, the heater core 37.

The heater core 37 has a similar function to the radiator 24 of FIG. 2. The engine coolant carrying heat from the engine 20 flows through the heater core 37. When an air passes through the heater core 37, the heat of the engine coolant is exchanged to the air. The controller 80 may control a pump (not shown) of the heater core 37 for controlling the flow of engine coolant through the heater core 37. The pump for the heater core may be similar to the pump used with the radiator 24.

An EONV leak check process for the third modification may be similar to the EONV leak check process of the above-described embodiment, where the air duct 35, the blower fan 36, and the heater core 37 function respectively similar to the air duct 30, the radiator cooling fan 23, and the radiator 24 in the above-described embodiment.

As such, the third modification can achieve effects similar to the effects of the above-described embodiment.

(Fourth modification)

Figure 8:
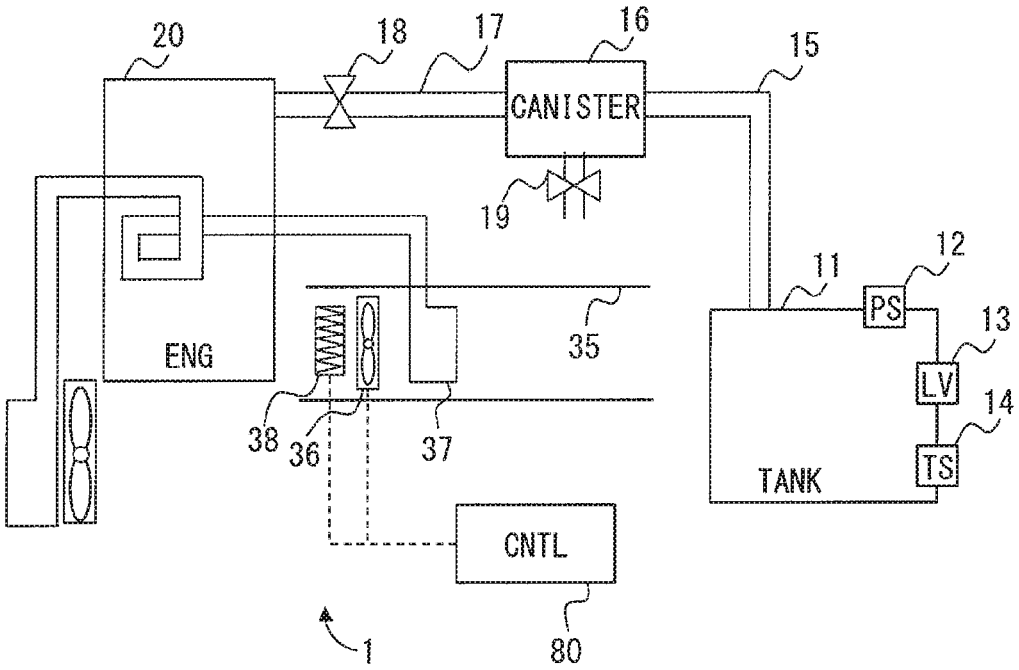
FIG. 8 is a schematic diagram of a modified configuration of an EONV leak check system.

A fourth modification is described with reference to FIG. 8.

The EONV leak check system 1 of the fourth modification may include a heater core 37, an air duct 35, a blower fan 36, and a heater 38. The heater core 37, the air duct 35 and the blower fan 36 may function similarly to the same corresponding elements described in the third modification. The fourth modification includes the addition of the heater 38. FIG. 8 shows the heater 38 disposed within the air duct 35. However, the position of the heater 38 is not limited to this example. That is, the heater 38 may be placed within the air duct 35, or may be attached to the side of the air duct 35.

The controller 80 may control the heater 38 similar to the control of the heater 31 described in the first modification. That is, the controller 80 may be used to turn the heater 38 off and on.

An EONV leak check process performed by the EONV leak check system 1 of the fourth modification is similar to the EONV leak check process performed by the EONV leak check system 1 of the first modification.

By using the configuration of the fourth modification, the EONV leak check system 1 can achieve the same effects as those in the above-described embodiment. Additionally, like the first modification, because the fourth modification includes an additional heater, such as the heater 38, the additional heater increases the likelihood that EONV leak check system 1 will perform the EONV leak check, because the heater 38 can be used to heat the fuel in the fuel tank 11 even when the temperature difference of the fuel heated by the engine coolant in the heater core 37 does not exceed the temperature threshold for performing the EONV leak check.

(Fifth Modification)

A configuration of a fifth modification and the EONV leak check process performed by the fifth modification are described with reference to FIGS. 9 and 10.

Figure 9:
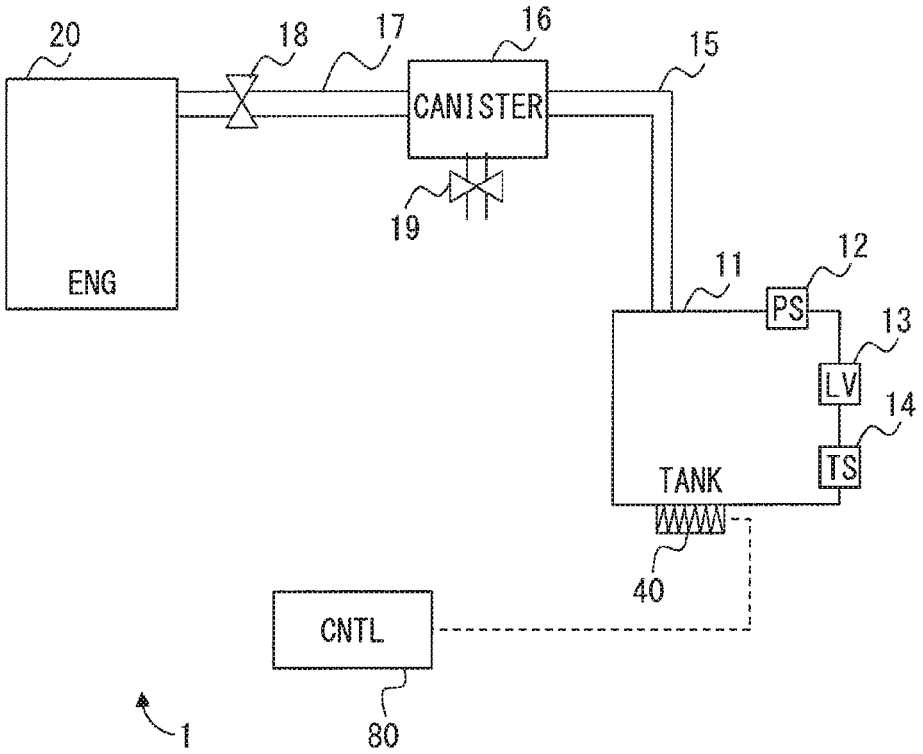
FIG. 9 is a schematic diagram of a modified configuration of an EONV leak check system.

With reference to FIG. 9, the EONV leak check system 1 in the fifth modification may include a heater 40 that is attached to the fuel tank 11 to directly heat the fuel tank 11. The EONV leak check system 1 includes a battery (not shown) for supplying electric power to the heater 40.

Figure 5:
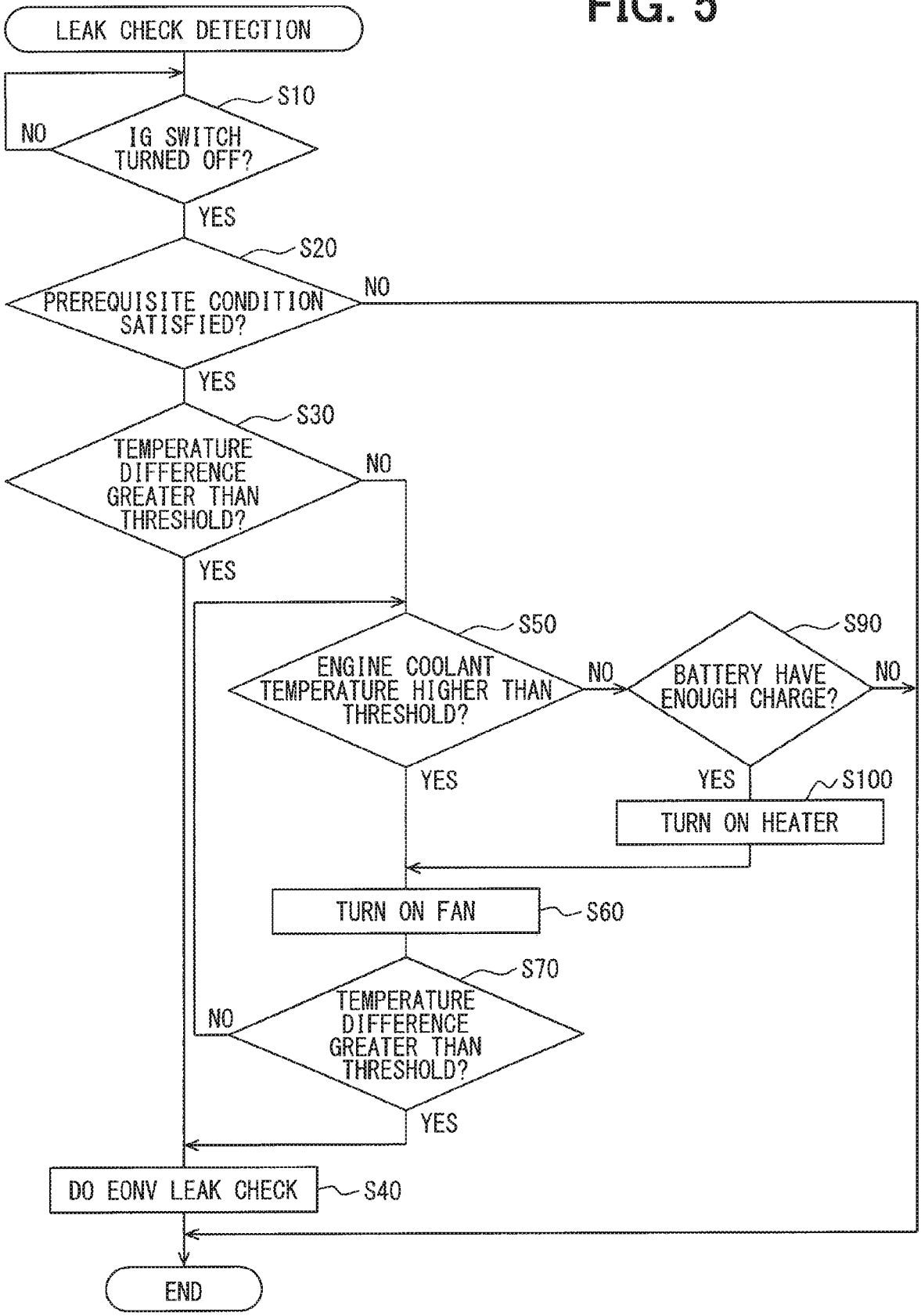
FIG. 5 is a flowchart of an evaporative fuel leak check process performed by the EONV leak check system of FIG. 4.
Figure 10:
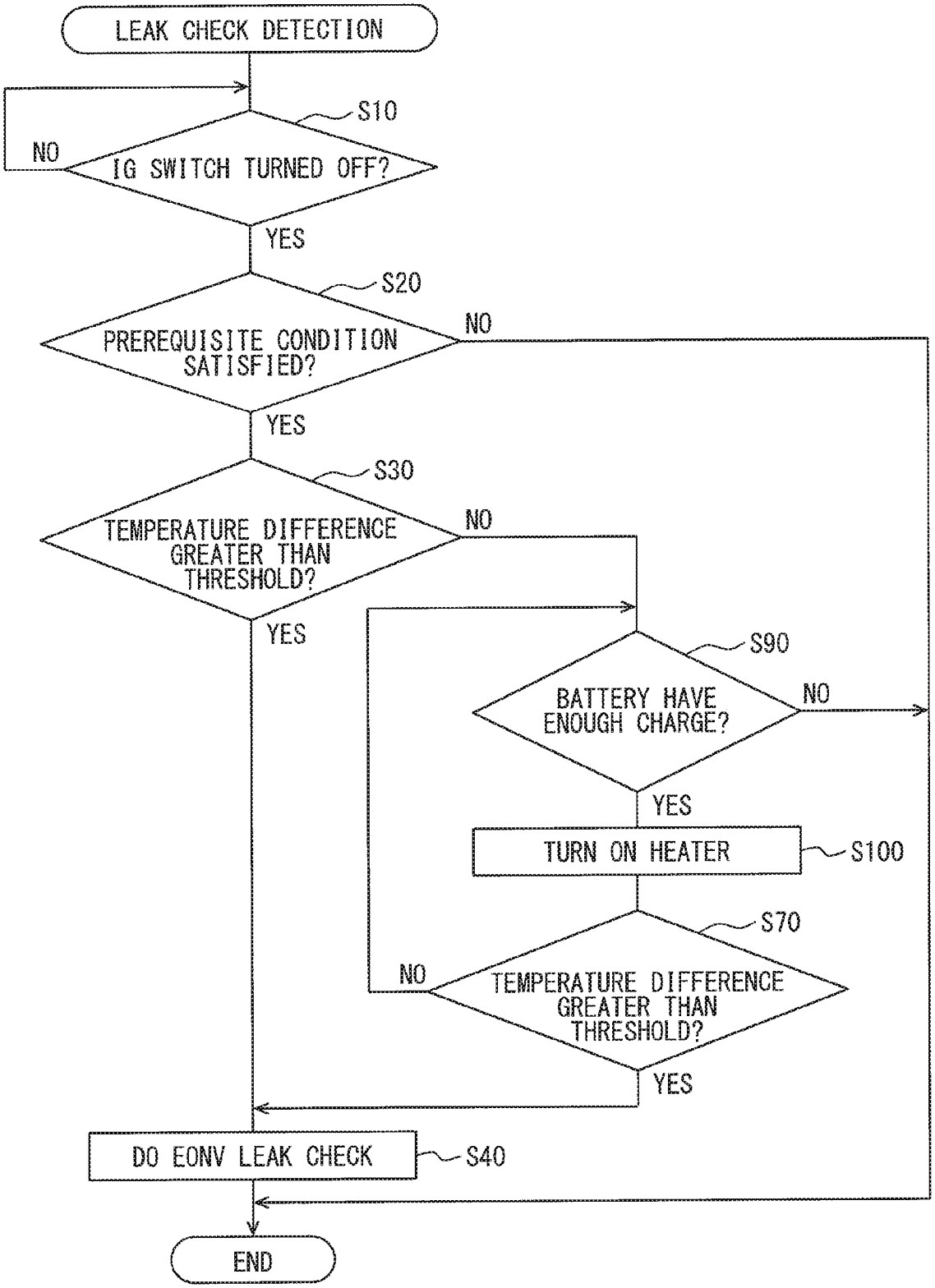
FIG. 10 is a flowchart of an evaporative fuel leak check process performed by the EONV leak check system of FIG. 9.

With reference to FIG. 10, the EONV leak check process performed by the fifth modification of the EONV leak check system 1 is similar to the process performed by the first modification in FIG. 5.

At S30, the evaporative fuel processing system is sealed, and the controller 80 determines whether the temperature difference of the fuel is greater than the threshold value as part of the pre-check process. Thereafter, the evaporative fuel processing system is opened to release pressure prior to performing the EONV leak check process.

When the temperature difference is greater than the threshold value, the procedure shifts to S40 and the controller 80 closes the evaporative fuel processing system and performs the EONV leak check process. However, in the fifth modification, when the temperature difference is not greater than the threshold value, i.e., "NO" at S30, the process proceeds directly to S90. At S90, the controller determines the state of charge (SoC) of the battery to determine whether the battery has enough charge to power the heater 40 to heat the fuel tank 11. If the battery has enough charge, i.e., "YES" at S90," the controller 80 closes valves 18 and 19 on the evaporative fuel processing system and turns on the heater 40, and at S70, the controller determines whether the temperature difference of the fuel in the fuel tank 11 exceeds a threshold value, and if "YES," the process proceeds to S40 and the controller performs the EONV leak check process. After S40, the leak check process ends.

Using the configuration of the fifth modification, the EONV leak check system 1 can achieve the same effects as those in the above-described embodiments. The use of heater 40 may increase the likelihood that EONV leak check system 1 will perform the EONV leak check, because the heater 40 can be used to heat the fuel in the fuel tank 11 when the temperature difference of the fuel does not exceed the threshold value for performing the EONV leak check.

Comparative Example

Figure 11:
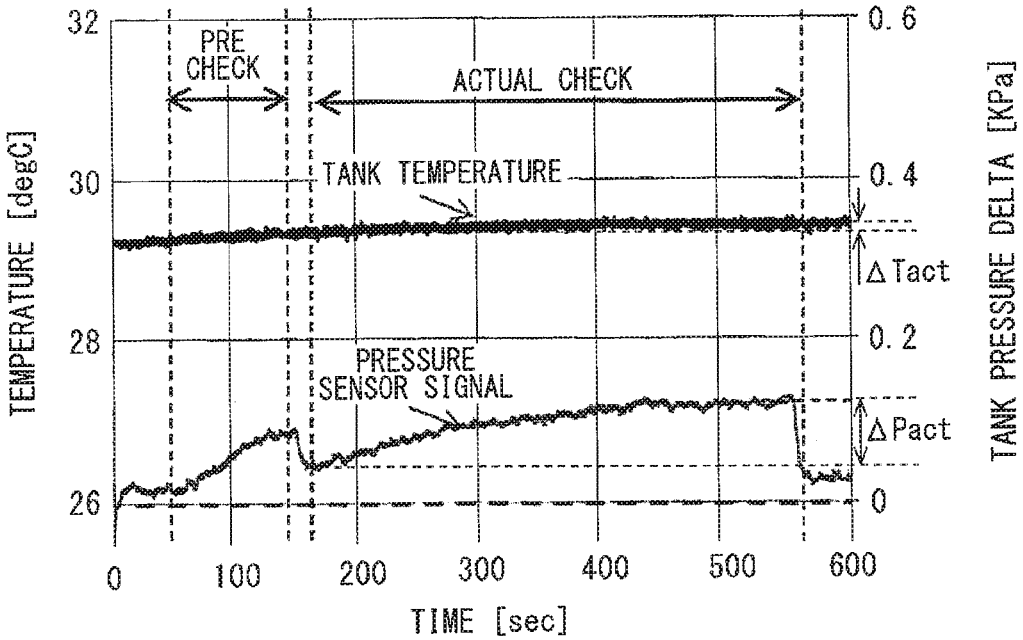
FIG. 11 illustrates a comparative example of temperature and pressure changes using a conventional evaporative fuel leak check system.
Figure 12:
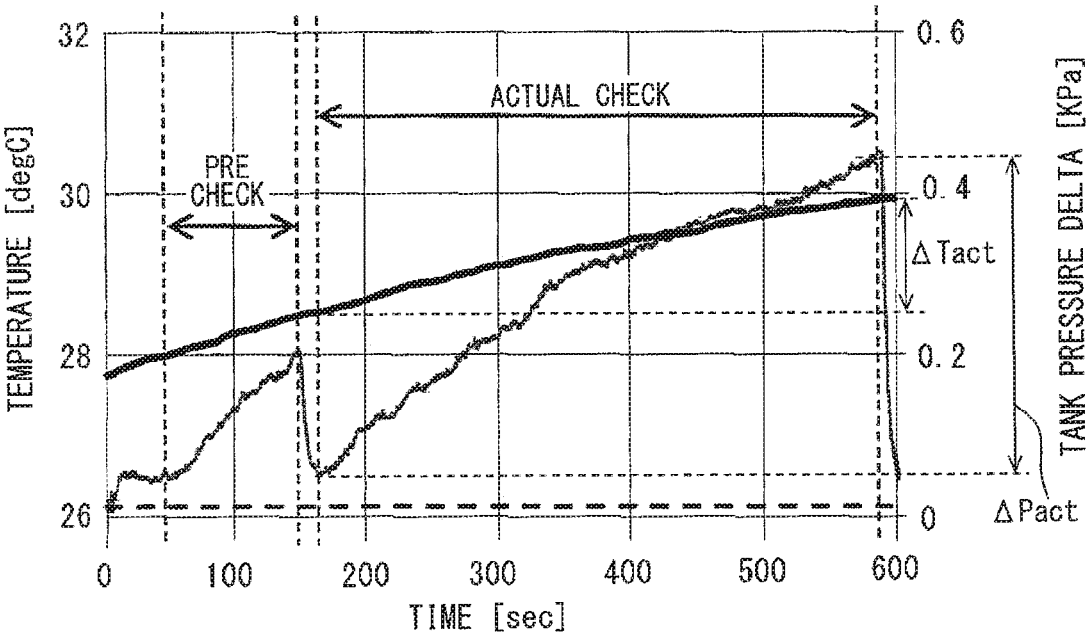
FIG. 12 illustrates example temperature and pressure changes using the EONV leak check system of the present disclosure.

FIGS. 11 and 12 illustrate a comparative example between the pressure differences ΔPact and temperature differences ΔTact generated by a conventional EONV leak check system and the EONV leak check system 1 of the present disclosure.

FIG. 11 illustrates the temperature difference ΔTact and the pressure difference ΔPact of a conventional EONV leak check system applied to a vehicle having a downsized engine, hybrid vehicle, or other fuel-saving technology where the vehicle engine may not constantly run (e.g., vehicles with start-stop systems). As shown in FIG. 11, the temperature difference ΔTact is relatively small and almost non-existent. That is, the temperature difference ΔTact is less than about 0.25° C. The residual heat from the engine heats the fuel in the fuel tank, causing the change in fuel temperature or the temperature difference ΔTact. Accordingly, by heating the fuel in the fuel tank, the pressure in the fuel tank and in the evaporative fuel processing system begins to change, causing the pressure difference ΔPact. In this case, the pressure beings to rise, rising about 0.1 KPa (i.e., ΔPact 0.1 KPa) during EONV leak check process.

With reference to FIG. 12, the temperature difference ΔTact and pressure difference ΔPact using the EONV leak check system 1 of the present disclosure are illustrated. In contrast to FIG. 11, the temperature difference ΔTact and pressure difference ΔPact shown in FIG. 12 are much larger. As a result, vehicles with downsized engines, hybrid vehicles, and vehicles with other fuel-saving technologies using the EONV leak check system 1 can produce larger temperature differences ΔTact and pressure differences ΔPact than those produced using the conventional EONV leak check system shown in FIG. 11. As such, temperature and pressure sensors may more readily detect the temperature and pressure differentials to determine evaporative fuel leaks.

As a result, the EONV leak check system 1 of the present disclosure provides a better indication of whether there are evaporative fuel leaks in the vehicle's evaporative fuel processing system by producing larger temperature differences ΔTact, and thus larger pressure differences ΔPact. The large pressure difference ΔPact produced by the EONV leak check system 1 of the present disclosure is indicative of an evaporative fuel processing system with no evaporative fuel leaks. As shown in FIG. 12, the temperature difference ΔTact produced by heating the fuel in the fuel tank 11 using the EONV leak check system 1 of the present disclosure creates a temperature difference ΔTact of about 1.5° C. during the actual EONV leak check process (e.g., after performing the pre-check process). Consequently, the pressure difference ΔPact caused by the temperature difference ΔTact during the actual EONV leak check process is about 0.4 KPa. As shown in FIG. 12, an example duration of the actual EONV leak check process may be about 400 seconds, approximately six to seven minutes.

Thus, the EONV leak check system 1 of the present disclosure can generate larger temperature differences ΔTact, and thus larger pressure differences ΔPact in vehicles having downsized engines, hybrid engines, and engines that run less, and thus can provide a better indication of evaporative fuel leaks in such vehicles.

Additionally, the EONV leak check system 1 of the present disclosure provides such vehicles with the ability to perform an EONV leak check process, where, when using a conventional leak check system, such vehicles may not have been able to perform such EONV leak checks, because the temperature difference during the pre-check did not exceed the threshold for performing the EONV leak check. Thus, the EONV leak check system 1 of the present disclosure may also increase the frequency at which the EONV leak check process can be performed.

An example embodiment and modifications are provided so that this disclosure will be thorough, and will fully convey the scope to those who are skilled in the art. Numerous specific details are set forth such as examples of specific components and methods to provide a thorough understanding of the embodiment and modifications of the present disclosure. It will be apparent to those skilled in the art that specific details need not be employed, that the example embodiment and modifications may be embodied in many different forms, and that neither should be construed to limit the scope of the disclosure. In the example embodiment and modifications, well-known processes, well-known device structures, and well-known technologies are not described in detail.

The terminology used herein is for the purpose of describing the example embodiment and modifications only and is not intended to be limiting. As used herein, the singular forms "a," "an," and "the" may be intended to include the plural forms as well, unless the context clearly indicates otherwise. The terms "comprises," "comprising," "including," and "having," are inclusive and therefore specify the presence of stated features, integers, steps, operations, elements, and/or components, but do not preclude the presence or addition of one or more other features, integers, steps, operations, elements, components, and/or groups thereof. The method steps, processes, and operations described herein are not to be construed as necessarily requiring their performance in the particular order discussed or illustrated, unless specifically identified as an order of performance. It is also to be understood that additional or alternative steps may be employed.

Although the terms first, second, third, etc. may be used herein to describe various elements, components, regions, layers and/or sections, these elements, components, regions, layers and/or sections should not be limited by these terms. These terms may be only used to distinguish one element, component, region, layer or section from another region, layer or section. Terms such as "first," "second," and other numerical terms when used herein do not imply a sequence or order unless clearly indicated by the context. Thus, a first element, component, region, layer or section discussed below could be termed a second element, component, region, layer or section without departing from the teachings of the example embodiments.

It is noted that a flowchart or the processing of the flowchart in the present application includes multiple steps (also referred to as sections), each of which is represented, for instance, as S10. Further, each step can be divided into several sub-steps, while several steps can be combined into a single step.

The foregoing description of the embodiment and modifications has been provided for purposes of illustration and description. It is not intended to be exhaustive or to limit the disclosure. Individual elements or features of the embodiment and modifications are generally not limited to the embodiment or modifications, but, where applicable, are interchangeable and can be used in the embodiment and other modifications, even if not specifically shown or described. Such variations are not to be regarded as a departure from the disclosure, and all such modifications are intended to be included within the scope of the disclosure.

What is claimed is:

1. An EONV evaporative fuel leak check system comprising:

a fuel tank that stores fuel;

a heat exchanger that heats air around the heat exchanger by exchanging a heat of an engine coolant flowing through the heat exchanger with the air;

an air duct that extends between the fuel tank and the heat exchanger;

a fan configured to move the air around the heat exchanger and further through the air duct toward the fuel tank;

a fuel temperature sensor that detects a temperature of the fuel and outputs a fuel temperature signal; and a controller configured to determine a fuel temperature difference over a predetermined duration based on fuel temperature signals detected by the fuel temperature sensor at a beginning and an end of the duration, wherein, when the fuel temperature difference is less than a fuel temperature difference threshold value, the controller is further configured to turn on the fan.

2. The system according claim 1, further comprising an engine coolant temperature sensor disposed at a position upstream of the heat exchanger and configured to detect a temperature of the engine coolant and output a coolant temperature signal, wherein the controller is further configured to determine the engine coolant temperature from the coolant temperature signal, and wherein when the engine coolant temperature is less than a coolant temperature threshold value, the controller is further configured to turn the fan off or maintain the fan in an off state.

3. The system according to claim 2, further comprising a first heater disposed in the air duct and configured to heat air within the air duct, and a battery that supplies the first heater with power.

4. The system according to claim 3, wherein the controller is further configured to determine a state of charge of the battery, and wherein the controller is further configured to control the first heater to heat the air within the air duct when (i) the engine coolant temperature is less than the coolant temperature threshold value and (ii) the state of charge of the battery is higher than a battery threshold level, and wherein the controller is further configured to turn on the fan to move the air heated within the air duct by the heater toward the fuel tank.

5. The system according claim 1, wherein the heat exchanger is a radiator, and the fan is a radiator cooling fan.

6. The system according claim 1, wherein the heat exchanger is a heater core, and the fan is a blower fan.

7. The system according to claim 1, further comprising a second heater that is attached to the fuel tank and configured to directly heat the fuel tank.

8. The system according to claim 7, wherein the controller is further configured to determine a state of charge of the battery, and wherein the controller is further configured to control the second heater to heat the fuel tank when the state of charge of the battery is higher than a battery threshold level.

9. A method for an EONV evaporation leak check comprising:

detecting a temperature differential of a fuel within a fuel tank; and turning on a fan to blow air on and around a heat exchanger to heat the air from an engine coolant within the heat exchanger and blow the heated air toward the fuel tank when the temperature differential of the fuel is lower than a fuel temperature difference threshold value.

10. The method for the EONV evaporation leak check according to claim 9, further comprising:

detecting a temperature of the engine coolant; and turning the fan off when the temperature of the engine coolant is lower than a coolant temperature threshold value.

11. The method for the EONV evaporation leak check according to claim 10, further comprising detecting a state of charge of a battery;

heating the air with a heater when the temperature of the engine coolant is lower than the engine coolant threshold value and the state of charge of the battery is higher than a battery threshold level; and turning on the fan to blow the air heated by the heater toward the fuel tank.

12. The method for the EONV evaporation leak check according to claim 9, further comprising detecting a state of charge of a battery;

detecting a temperature of the engine coolant; and heating the fuel tank with a second heater disposed directly on the fuel tank when the state of charge of the battery is higher than a battery threshold level and the temperature of the engine coolant is less than a coolant temperature threshold value.

* * * * *